United States Patent [19]

Collins et al.

[11] 4,257,430

[45] Mar. 24, 1981

[54] TOBACCO COMPOSITION INCLUDING PALLADIUM

[75] Inventors: Peter F. Collins; Herman G. Bryant, Jr., both of Durham; James O. Pullman, Chapel Hill, all of N.C.

[73] Assignee: Liggett Group Inc., Montvale, N.J.

[21] Appl. No.: 13,575

[22] Filed: Feb. 21, 1979

[51] Int. Cl.[3] ..... A24B 15/28; A24B 15/42

[52] U.S. Cl. ..... 131/140 B

[58] Field of Search ..... 131/140 B, 17 R, 2, 131/15 R, 140 R

[56] References Cited

U.S. PATENT DOCUMENTS 4,055,191 10/1977 Norman et al. ..... 131/9

*Primary Examiner*—Vincent Millin

*Attorney, Agent, or Firm*—J. Bowen Ross, Jr.

[57] ABSTRACT

Improved palladium-containing smoking tobacco compositions wherein the palladium in a highly active form is obtained by depositing on the tobacco palladium which has been insolubilized by admixing in an aqueous medium a water-soluble palladium compound and a reducing agent capable of reducing dissolved palladium cations to insoluble palladium. Methods for determining the amount of insoluble or active palladium are described.

8 Claims, No Drawings

TOBACCO COMPOSITION INCLUDING PALLADIUM

This invention relates to smoking compositions comprising tobacco having associated therewith palladium as a catalytic agent. More particularly, the present invention is concerned with tobacco compositions including palladium as a catalytic agent wherein the palladium is in a highly active form. This invention is also concerned with a method for admixing smoking tobacco and palladium whereby the palladium is deposited in a highly active catalytic form.

RELATED APPLICATIONS AND PATENTS

The subject matter of this invention is related to the subject matter of U.S. Pat. No. 4,055,191, granted Oct. 25, 1977 to V. Norman and H. G. Bryant, Jr. for "Tobacco Composition", and (Ser. No. 344,589 filed Mar. 26, 1973 by H. G. Bryant, Jr., T. B. Williams and V. Norman for "Smoking Composition").

BACKGROUND

As is summarized in U.S. Pat. No. 4,055,191, the proportion of polycyclic aromatic hydrocarbons (PCAH) in the smoke from tobacco can be materially reduced by incorporating palladium into the tobacco. It is further disclosed that palladium in combination with a nitrate salt, preferably magnesium nitrate, is even more efficient in reducing PCAH. Moreover, the combination of palladium and nitrate was shown in tests on mice to materially reduce the biological activity of tobacco smoke condensate obtained by smoking cigarettes on a wheel-type smoker as described in

DESCRIPTION OF THE INVENTION

In work undertaken to evaluate the effect of palladium and nitrate on the biological activity of tobacco smoke, certain anomalous results were observed. Subsequent evaluation of the data obtained in the course of this work indicated that the activity of the palladium depended on the form of the palladium which was deposited on the tobacco, which in turn was highly dependent upon the procedure employed. More particularly, it has been found in accordance with this invention that the effectiveness of palladium in reducing the biological activity of tobacco smoke is dependent on the amount of "non-extractable palladium", as hereinafter defined, which is deposited on the tobacco. The amount of "non-extractable palladium", in turn, is dependent on the deposition of the palladium from an aqueous composition including "insoluble palladium", as hereinafter defined.

Accordingly, it is an object of this invention to provide a smoking tobacco including palladium in a highly active form.

It is another object of this invention to provide palladium-treated smoking articles wherein the palladium is in a form which minimizes the biological activity of the smoke therefrom.

Still another object of this invention is to provide a method for depositing palladium on tobacco in a more active form.

More specifically, an object of this invention is the provision of a method for depositing palladium on smoking tobacco which maximizes the proportion of non-extractable palladium on the tobacco.

A still further object of this invention is the provision of an analytical method for determining the proportion of palladium which is in a form capable of reducing the biological activity of tobacco smoke.

According to U.S. Pat. No. 4,055,191, palladium is incorporated into a tobacco composition either in finely-divided metallic form and/or in the form of a palladium salt which is decomposable, in situ, preferably by heat, into metallic palladium. A preferred procedure which is disclosed is the deposition of palladium, initially in the form of an ammonium chloropalladate salt, in combination with a nitrate compound, from a solution of these additives in a conventional casing solution comprising glycerine, propylene glycol and sugars.

It has been discovered in accordance with this invention that the catalytic activity of the palladium is highly dependent upont the proportion of palladium which is in the form of "non-extractable palladium", which in turn is highly dependent upon the conditions under which the palladium is applied to the tobacco.

As employed herein, the term "extractable palladium" is that palladium deposited on the tobacco which can be extracted from treated tobacco by aqueous, alkaline ethylenediamine tetraacetic acid (EDTA). The chemical form of this "extractable palladium" is not known; it may be a form of metallic palladium in view of available evidence that the extracting medium can dissolve small particles of palladium metal, or it may be inoic palladium or a mixture of metallic anc ionic palladium. The term "non-extractable palladium" as employed herein is that palladium deposited on the tobacco which is not extracted from treated tobacco by aqueous, alkaline EDTA. The form of this "non-extractable" palladium is thought to be metallic palladium on the basis of available evidence. The specific value of extractable palladium which is obtained will be dependent, inter alia, on the composition of the EDTA reagent, and the conditions of the treatment of the casing or tobacco. However, for each set of conditions, consistent results are obtained, and it is estimated that a single determination of extractable palladium has a standard deviation of 0.001 percent palladium, which corresponds to about 1 to about 10 percent of the total palladium preferably employed in accordance with U.S. Pat. No. 4,055,191.

In the practice of this invention, there is formed an aqueous solution containing a dissolved palladium compound and a compound which acts as a reducing agent for ionic palladium. The solution is heated at a temperature of up to about 80° C. for a period of time sufficient to form "insoluble palladium", and the resulting mixture is blended with tobacco to deposit the palladium on the tobacco.

As employed herein, "soluble palladium" is that palladium in an aqueous mixture, which when the mixture is diluted with water and filtered through a membrane filter with 0.45$\mu$ pores, appears in the filtrate. The palladium which is retained on the filter is defined as "insoluble palladium". The chemical form of this "insoluble palladium" has been found to be predominantly, if not completely, metallic palladium. The chemical form of the "soluble palladium" is considered to be essentially all ionic, based on available evidence. Though the precise forms of soluble and insoluble palladium have not been conclusively established, the present invention is intended to extend to "insoluble palladium" formed in the manner described, regardless of the precise chemical and physical form of the palladium.

The palladium compound which is employed can be any water-soluble compound containing palladium which is capable of yielding ionic palladium, such as the salts disclosed in U.S. Pat. No. 4,055,191. Such compounds include simple salts such as palladium nitrate, palladium halides such as palladium chloride, diammine complexes such as palladous dichlorodiammine ($Pd(NH_3)_2Cl_2$), and palladate salts, especially ammonium salts such as ammonium tetrachloropalladate and ammonium hexachloropalladate.

The amount of palladium compound in solution is not critical, provided the concentration is adequate to deposit sufficient palladium on the tobacco to provide the desired catalytic effect. As is taught by U.S. Pat. No. 4,055,191, the palladium can be present in the tobacco in amounts of from about 0.001 to about 1 weight percent, and preferably from about 0.01 to about 0.1 weight percent. It has been found that the rate of the reduction of soluble palladium to insoluble palladium increases with decreasing palladium concentration. On the other hand, if the solution is too dilute, excessive amounts of solution may be required to deposit a catalytically effective amount of palladium. In general, palladium concentrations of from about 0.1 to about 2 weight percent palladium are useful, with concentrations of from about 0.2 to about 0.5 weight percent palladium being preferred.

A second required component of the solution (other than water) is a reducing agent capable of reducing dissolved palladium ionic to metallic palladium. Since palladium salts are well known as oxidizing agents any mild reducing agent may be used. Although any compound capable of reducing ionic palladium can be employed, as a practical matter the reducing agent should be non-toxic and should not form toxic by-products when pyrolyzed during smoking. In addition, the reducing agent should be water soluble. Preferred reducing agents are organic aldehydes, including hydroxyl containing aldehydes such as the sugars, e.g. glucose, mannose, galactose, xylose, ribose, arabinose. Other sugars containing hemiacetal or keto groupings may be employed, e.g. maltose, sucrose, lactose, fructose and sorbose. Pure sugars may be employed, but crude sugars and syrups such as honey, corn syrup, invert syrup and the like may also be employed. Other, albeit less effective reducing agents include alcohols, preferably polyhydric alcohols, such as glycerol, sorbitol, the glycols, especially ethylene glycol and propylene glycol, and polyglycols such as polyethylene and polypropylene glycols. Albeit, other less effective reducing agents may be used such as carbon monoxide, hydrogen, ethylene, and titanous salts.

The solution may contain still other additives which do not interfere with the interaction of the palladium compound and the reducing agent. Thus, the solution may contain a nitrate salt of the type disclosed in U.S. Pat. No. 4,055,191.

It will be appreciated by those skilled in the art that the reducing agents referred to above are commonly employed components of casing solutions heretofore employed in the manufacture of smoking tobacco, and indeed the addition of a water-soluble palladium salt to a conventional casing solution is a convenient, and preferred, method of practicing the present invention. Although the use of such casing solutions has been described in U.S. Pat. No. 4,055,191, there is no recognition in that patent that a heating step, as hereinafter described, is required as a practical matter to form insoluble palladium.

The insolubilization of palladium will occur very slowly at ambient temperature, and excessively long periods of time are required to achieve practical conversions of the soluble palladium to insoluble palladium. Consequently, to achieve practical rates of conversion the solution is heated at elevated temperatures, with the rate of formation of insoluble palladium increasing with increasing temperature. However, as the temperature increases, the insoluble palladium tends to form agglomerates of insoluble palladium which presents difficulties in obtaining uniform distribution of the metal. The formation of such agglomerates can be inhibited through the inclusion of protective colloids such as gelatin, gums such as gum tragacanth, and the like, in amounts of up to about 1 weight percent, and preferably from about 0.2 to about 0.6 weight percent as described in U.S. application, Ser. No. (Our Ref. Case 289), filed on even date herewith, the disclosure of which is incorporated herein by reference. However, at temperatures in excess of about 90° C., the formation of the palladium agglomerates becomes excessive. Furthermore, extended heating at elevated temperatures can cause breakdown of sugars or other compounds present in the aqueous solution, forming decomposition products which have an adverse effect on the taste of tobacco smoke. In general, then, temperatures in the range of from about 50° C. to about 90° C. are employed, with temperatures of from about 70° C. to about 80° C. being preferred.

The heating is carried out for a period of time sufficient to effect the desired degree of conversion of soluble palladium to insoluble palladium. It is preferred that there be substantially total conversion of soluble palladium to insoluble palladium, thereby achieving the maximum catalytic activity possible. Complete conversion is not essential, however, and useful results are achieved when the proportion of soluble palladium is reduced to less than about 50 percent of the total palladium in the solution. It is preferred, however, that the soluble palladium in the solution be reduced to not more than 5 percent of total palladium. In general, this will require heating for at least about 4 hours at 75°–80° C., and a correspondingly longer time at lower temperatures. Heating for still longer times can be employed if desired, but ordinarily is unnecessary. Extended heating periods, i.e., for 24 hours or more, especially at temperatures of about 80° C., or above, are not desired because of the increased risk of agglomeration or the formation of undesirable degradation products.

After formation of insoluble palladium, the resulting aqueous mixture is then applied to the tobacco by any suitable technique, such as those commonly employed to apply casing solutions to tobacco. For example, the mixture may be sprayed onto the tobacco. The thus-treated tobacco is then formed into smoking articles such as cigars or cigarettes, or packaged as pipe tobacco.

The resulting tobacco product will contain non-extractable palladium in an amount proportional to the amount of insoluble palladium in the solution used to treat the tobacco. However, the relative proportion of non-extractable to total palladium in the tobacco will be somewhat less than the proportion of insoluble to total palladium in the treating solution. When the preferred levels of soluble palladium (5 percent or less of the total palladium) are achieved in the aqueous medium, the extractable palladium ordinarily comprises no more than about 10 percent of the total palladium in the tobacco.

This difference may be due to the use of alkaline EDTA as the extracting medium. It also has been observed that the specific base employed in preparing the alkaline EDTA extraction medium will affect the absolute value of extractable palladium found. Consequently, in analyzing for extractable palladium it is important that the same extraction medium be employed. The alkali metal hydroxides, e.g., sodium hydroxide and potassium hydroxide, and ammonium hydroxide are the preferred alkaline materials used to form the extraction medium. Ammonium hydroxide is especially preferred. The pH of the extraction medium is not narrowly critical, nor is the concentration of EDTA. It is preferred, however, that the pH be approximately 10 (i.e., from about 9.5 to about 10.5), and that the concentration of EDTA be approximately 0.1 molar (i.e., from about 0.09 to about 0.11 molar). So long as the composition of the extraction medium is maintained constant, reliable results permitting accurate control of the process are obtained.

The following examples are illustrative of the present invention, including the preparation of casings containing insoluble palladium, the formation of tobacco compositions containing non-extractable palladium, and the testing of such tobacco compositions. In the examples, the tobacco samples and the casing samples were analyzed for non-extractable and insoluble palladium, respectively, by the following procedures:

I. Analysis for Non-Extractable Palladium in Tobacco

The "non-extractable" palladium is the palladium in tobacco which is not extracted with ammoniacal ethylenediamine tetra-acetic acid, and is determined by subtracting the extractable palladium from total palladium. The total palladium and extractable palladium are determined by the following procedure:

Determination of "Total Palladium" In Tobacco

An accurately weighed sample of about 1 gram of tobacco is placed in a 100-ml beaker, 5 to 10 ml of 1:1 reagent grade nitric acid and reagent grade perchloric acid is added, the beaker is covered with a cover glass and heated on an electrical hot plate at a moderate rate for at least 2 hours. The cover is then removed, and heating is continued to evaporate the sample to dryness. The beaker is then cooled to ambient temperature, 1 ml of reagent grade concentrated hydrochloric acid is added, and the cover is replaced. The mixture is heated to boiling momentarily, 10 ml of 0.1 N nitric acid is added, and the solution is digested by heating near boiling (80°–100° C.) for 10 minutes. The solution is cooled to ambient temperature, and diluted with 0.1 N nitric acid to 25 ml to form an analytical sample.

Determination of "Extractable Palladium" From Tobacco

An accurately weighted sample of tobacco weighing from about 1 to about 2 grams is mixed with 50 ml of an ammoniacal solution of ethylenediamine tetra-acetic acid (EDTA) (0.1 M in EDTA and 1 M in $NH_4OH$) having a pH of about 10. The resulting mixture is continuously agitated for 30 minutes, and is immediately filtered through a membrane filter having pore size of not greater than 0.45 microns. A 10.0 ml portion of the filtrate is evaporated to dryness in a 100-ml beaker and 5 to 10 ml of 1:1 reagent grade nitric acid and reagent grade perchloric acid is added to the residue. The beaker is covered with a cover glass and heated on an electrical hot plate at a moderate rate for at least 2 hours after the appearance of $HClO_4$ fumes, the cover is then removed and heating is continued to evaporate the sample to dryness. The beaker is cooled to ambient temperature, 1 ml of concentrated reagent grade hydrochloric acid is added, the cover is replaced and the mixture is heated to boiling. Then 10 ml of water are added to the residue and the mixture is digested by heating near boiling (80°–100° C.) for 10 minutes. The solution is then cooled to room temperature and diluted to 25 ml with water to form a sample to be subjected to analysis for palladium.

II. Analysis for Insoluble Palladium in Casing

The insoluble palladium in the casing is that palladium in casing which is not soluble in water, and is determined by subtracting soluble palladium from total palladium. Total and soluble palladium are determined by the following procedures:

Determination of "Total Palladium" In Casing

An accurately weighed sample of about 0.3 gm of well mixed casing is placed in a 100-ml beaker, and 5 to 10 ml of 1:1 nitric acid and perchloric acid is added. The resulting mixture is then worked up following the procedures described for determining total palladium in tobacco.

Determination of "Soluble Palladium" In Casing

A 0.3 to 3.0 ml portion of casing is accurately weighed in a 10 ml volumetric flask, and is diluted to 10 ml with water. The resulting solution is thoroughly mixed and is immediately filtered through a membrane filter having a pore size of not greater than 0.45 microns. A 2 to 5 aliquot of filtrate is mixed with 5 to 10 ml of 1:1 nitric acid and perchloric acid, and the resulting solution is treated as described above to achieve a sample for analysis for "soluble palladium". In carrying out this procedure, it is desirable to select sample and aliquot sizes so that there will be at least 15 micrograms, and preferably 50 to 200 micrograms, of palladium in the sample for analysis.

III. Palladium Analysis

Any procedure capable of accurately determining the quantity of palladium in the thus-obtained samples of "Total", "Extractable" and "Soluble" palladium may be employed. When analyzing for total palladium, atomic absorption spectroscopy has been found sufficient. When analyzing for "Extractable" or "Soluble" palladium, however, a more sensitive procedure is desirable. It has been found that the procedure of O. Menis and T. C. Rains, "Colorimetric Determination of Palladium With Alpha-Furildioxime," Anal. Chem., 27, 1932–34 (1955), is suitable for this purpose. In the examples which follow, "Extractable" or "Soluble" palladium was determined by adapting the Menis et al. procedure to automatic analysis with a Technicon Auto-Analyzer I.

EXAMPLE 1

A casing formulation was prepared in accordance with the following table:

| Component | Weight Percent |
|---|---|
| Invert Sugar | 23.56 |
| Glycerine | 3.84 |
| Corn Syrup | 6.12 |
| Flavor | 3.87 |
| Gum Tragacanth | 0.25 |
| $Mg(NO_3)_2 \cdot 6H_2O$ | 34.30 |
| 5% Aq*$(NH_4)_2Pd(Cl_4)$ (pH = 1.5) | 10.30 |
| Water | 17.76 |
| | 100.00 |

*Aqueous

The resulting solution was heated at 77° C. and the solution was periodically analyzed for soluble palladium and total palladium. The results of these analyses are summarized as follows:

| | Palladium Present in Casing as % of Total Palladium | |
|---|---|---|
| Time, hr. | Soluble | Insoluble |
| 1 | 27.5 | 72.5 |
| 2 | 15 | 85 |
| 3 | 10 | 90 |
| 4 | 7 | 93 |
| 5 | 3 | 97 |
| 20 | 1 | 99 |

The formation of insoluble palladium was found to occur in two stages: the first, by a rapid reaction which is essentially complete in about 1 hour, and the second by a slower reaction which appears to obey first order kinetics.

EXAMPLE 2

A series of experiments was undertaken to evaluate the effect of temperature on the rate of formation of insoluble palladium in a casing formulation containing:

| Component | Weight Percent |
|---|---|
| Invert Sugar | 15.4 |
| Flavor | 4.4 |
| Propylene glycol | 2.2 |
| Glycerine | 6.5 |
| Corn Syrup | 4.9 |
| Lactic Acid | 0.5 |
| $(NH_4)_2PdCl_6$ | 1.2 |
| $Mg(NO_3)_2 \cdot 6H_2O$ | 31.7 |
| Water | 33.2 |
| | 100.0 |

Three separate mixtures were prepared, held at 23° C., 60° C. or 70° C., and periodically analyzed to determine soluble palladium. The insoluble palladium formed after one hour was determined, and is used as a measure of the rate of the first stage reaction. In addition, the first order rate constant, k was calculated from a plot of the logarithm of soluble palladium against time. The data are summarized as follows:

| Temperature, °C. | Insoluble Palladium Formed in 1 Hr., as % of Total Palladium | Rate Constant, k, $hr.^{-1}$ |
|---|---|---|
| 23 | 0 | 0.00 |
| 60 | 36 | 0.03 |
| 70 | 41 | 0.19 |

EXAMPLE 3

Employing procedures and materials similar to those described in Example 2, except that the casing solution contained 1.5 percent $(NH_4)_2PdCl_4$ rather than 1.2 percent $(NH_4)_2PdCl_6$, and the amounts of $Mg(NO_3)_2.6H_2O$, glycerine and water were each reduced by 0.1 percent, there was prepared a casing solution having a pH of 2.5, in contrast to a pH of 0.8 for the solutions of Example 2. The solution was heated at 70° C. and periodically analyzed for soluble palladium. The insoluble palladium formed in the first hour was 59 percent of the total palladium, and the first order rate constant, k was 0.25 $hr.^{-1}$.

EXAMPLE 4

The experiments described in Example 3 suggested that pH affected the rate of formation of insoluble palladium; however, the level of total palladium in that experiment was greater than in the experiments described in Example 2. Consequently, two new experiments were performed at constant total palladium content to evaluate the effect of pH alone. The compositions of the casing solution and the analytical results after heating at 70° are as follows:

| | Solution | |
|---|---|---|
| Component, weight % | A | B |
| Invert Sugar | 10.2 | 10.1 |
| Flavor | 2.9 | 2.8 |
| Propylene glycol | 1.4 | 1.4 |
| Glycerine | 4.3 | 4.3 |
| Corn Syrup | 3.2 | 3.2 |
| Lactic acid | 0.3 | 0.3 |
| $(NH_4)_2PdCl_6$ | 0.80 | — |
| $(NH_4)_2PdCl_4$ | — | 0.6 |
| (Total Pd) | (0.22) | (0.22) |
| $Mg(NO_3)_2 \cdot 6H_2O$ | 18.7 | 18.6 |
| Water | 58.2 | 58.7 |
| Total | 100.00 | 100.00 |
| pH | 0.8 | 2.5 |
| Insoluble Pd as % of Total Palladium, 1 hr. | 56 | 83 |
| Reaction Constant, k, $hr.^{-1}$ | 0.25 | 0.61 |

EXAMPLE 5

Several casing solutions containing various amounts of soluble palladium were prepared and employed to treat tobacco samples which then were analyzed for extractable palladium. The data for these runs is summarized as follows:

| | % of Total Palladium | |
|---|---|---|
| Sample | Soluble Pd in Casing | Extractable Pd in Tobacco |
| 1 | 74.7 | 87.1 |
| 2 | 67.0 | 80.4 |
| 3 | 61.4 | 68.3 |
| 4 | 46.9 | 63.3 |
| 5 | 32.8 | 49.7 |
| 6 | 25.8 | 42.7 |

As is evident from the foregoing, the proportion of extractable palladium in the tobacco is proportional to, but greater than, the proportion of soluble palladium in the casing solution. Consequently, even if the amount of soluble palladium in the casing is reduced to zero, the resulting tobacco will nonetheless contain extractable palladium, perhaps amounting to 10 percent or less of the total palladium.

EXAMPLE 6

Employing procedures similar to those described in the Biological Test described in U.S. Pat. No. 4,055,191, cigarette tobacco was treated with casings including palladium. The tobaccos employed had varying natural nitrate contents, and in some instances the casings also contained added magnesium nitrate. The tobacco samples were then employed to prepare sample cigarettes which then were smoked on the wheel-type smoker to collect smoke condensate used for mouse-painting tests. For each tobacco sample, the incidence of tumor-bearing mice, as a percentage of the total mice at risk, was determined after 80 weeks. In addition, the nitrate content (native nitrate and added nitrate) and the palladium content (total and non-extractable) was determined. Finally, the yield of polycyclic aromatic hydrocarbons in the dry smoke was determined. The data are summarized in Tables I and II.

TABLE I

Summary of Content of Tobacco Samples

| Series | Sample | Nitrate Content, % Native | Nitrate Content, % Total | Palladium Content, ppm Total | Palladium Content, ppm Non-Extractable |
|---|---|---|---|---|---|
| A | 1* | 0.22 | 0.22 | 0 | — |
| | 2* | 0.22 | 0.22 | 470 | 300 |
| | 3* | 0.30 | 0.74 | 550 | 360 |
| B | 1 | 0.22 | 0.22 | 0 | — |
| | 2 | 0.47 | 0.47 | 580 | 80 |
| | 3 | 0.59 | 0.59 | 580 | 140 |
| C | 1 | 0.17 | 0.17 | 0 | — |
| | 2 | 0.55 | 0.55 | 0 | — |
| | 3 | 0.28 | 0.75 | 0 | — |
| | 4 | 0.29 | 0.73 | 440 | 260 |
| D | 1 | 0.23 | 0.23 | 0 | — |
| | 2 | 0.31 | 0.77 | 550 | 160 |
| | 3** | 0.69 | 0.69 | 660 | 180 |
| | 4 | 0.80 | 0.80 | 820 | 210 |

*These samples are the controls and Samples A and B employed in the "Biological Test" of U.S. Pat. No. 4,055,191.

**0.42 weight % Mg added as a 1/1 mixture of magnesium maleate and magnesium acetate to the tobacco

TABLE II

Summary of Evaluation of Tobacco Smoke and Condensate

| Series | Sample | Active PCAH Yield, mg per gram of dry smoke | % of Animals with Tumors |
|---|---|---|---|
| A | 1 | 2.258 | 42.0 |
| | 2 | 2.073 | 39.6 |
| | 3 | 1.412 | 2.3 |

TABLE II-continued

Summary of Evaluation of Tobacco Smoke and Condensate

| Series | Sample | Active PCAH Yield, mg per gram of dry smoke | % of Animals with Tumors |
|---|---|---|---|
| B | 1 | 2.329 | 47.9 |
| | 2 | 1.551 | 32.6 |
| | 3 | 1.538 | 43.8(22.5)* |
| C | 1 | 2.245 | 41.9 |
| | 2 | 1.948 | 41.3 |
| | 3 | 1.895 | 27.1 |
| | 4 | 1.537 | 8.3 |
| D | 1 | 2.148 | 55.3 |
| | 2 | 1.272 | 17.0 |
| | 3 | 1.419 | 21.7 |
| | 4 | 1.258 | 25.0 |

*In this experiment, there was a sudden anomolous increase in the number of tumor bearing mice following the 74th week. The value in parentheses is estimated from the tumor incidence observed through the 74th week (20%).

In the four series of tests, Samples A-1, B-1, C-1 and D-1 served as controls. For purposes of evaluating the effect of changes in nitrate and palladium content, and the amount of non-extractable palladium on biological activity, the individual values for percent tumor incidence and yield of PCAH were averaged.

| Sample | Yield of PCAH | % of Tumor Incidence |
|---|---|---|
| A-1 | 2.258 | 42.0 |
| B-1 | 2.329 | 47.9 |
| C-1 | 2.245 | 41.9 |
| D-1 | 2.148 | 55.3 |
| Average | 2.245 | 46.8 |

For each experimental run, the ratios of the observed yield of PCAH and tumor incidence to the average of the control values were calculated. The results are summarized in Table III.

TABLE III

PCAH Yields and Tumor Incidence of Test Samples Compared With Controls

| Sample | Total Nit. Nitrogen % | Added Nit. Nitrogen %* | ppm Pd Total | ppm Pd Non-Ext | PCAH Yield As % of Ave. Con. | Biological Response as % of Avg Control |
|---|---|---|---|---|---|---|
| A-2 | 0.22 | — | 470 | 300 | 92.3 | 84.6 |
| C-2 | 0.55 | — | 0 | — | 88.4 | 88.2 |
| B-2 | 0.47 | — | 580 | 80 | 69.1 | 69.7 |
| B-3 | 0.59 | — | 580 | 140 | 68.5 | (56)** |
| D-4 | 0.80 | — | 820 | 210 | 56.0 | 53.4 |
| D-3* | 0.69 | — | 660 | 180 | 63.2 | 46.4 |
| C-3 | 0.75 | 0.47 | 0 | — | 84.4 | 57.9 |
| D-2 | 0.77 | 0.46 | 550 | 160 | 56.7 | 36.3 |
| C-4 | 0.73 | 0.44 | 440 | 260 | 68.5 | 17.7 |
| A-3 | 0.74 | 0.44 | 550 | 360 | 62.9 | 4.9 |

*Added as $Mg(NO_3)_2 \cdot 6H_2O$

**Extrapolated from data curve from 74 week results to 80 weeks

As is evident from the foregoing, the yield of polycyclic aromatic hydrocarbons and the incidence of tumors in mice both decrease as the amount of non-extractable palladium increases. In general, substantial reductions in the incidence of tumors are achieved when the amount of total nitrate is in excess of about 0.4 weight percent and the amount of non-extractable palladium is greater than about 100 ppm. It is preferred, however, that there be employed at least about 0.7 weight percent total nitrate nitrogen and at least about 250 ppm of non-extractable palladium. Most preferably, there should be employed at least about 0.7 weight percent total nitrogen and at least about 450 ppm of non-extractable palladium.

What is claimed is:

1. A method for the deposition of catalytically active metallic palladium on smoking tobacco comprising:

(a) Forming an aqueous solution containing a soluble palladium compound, and a compound capable of reducing ionic palladium cations to palladium metal, said solution having a pH of no more than 3;

(b) Heating said solution at an elevated temperature for a period of time sufficient to convert at least about 50 percent of the palladium to insoluble palladium; and (c) Admixing the casing solution with tobacco to deposit thereon said insoluble palladium.

2. A method according to claim 1 wherein said reducing agent is a hydroxyl containing aldehyde.

3. A method according to claim 2 wherein said reducing agent is a sugar.

4. A method according to claim 1 wherein said aqueous solution containing palladium is a casing solution including at least one sugar and at least one polyhydroxy compound.

5. A method according to claim 4 wherein said soluble palladium compound is selected from the group consisting of palladium nitrate, palladium chloride, palladous dichlorodiamine, ammonium tetrachloropalladate and ammonium hexachloropalladate.

6. A method according to claim 5 wherein said palladium salt is ammonium tetrachloropalladate.

7. A method according to claim 1 wherein said heating is at a temperature of from about 50° C. to about 90° C.

8. A method according to claim 4 wherein said heating is at a temperature of from about 50° C. to about 90° C. for a period of time sufficient to convert at least 95 percent of soluble palladium to insoluble palladium.

* * * * *